US008053042B1

(12) United States Patent
Loomis

(10) Patent No.: US 8,053,042 B1
(45) Date of Patent: Nov. 8, 2011

(54) ARTIFICIAL TREE APPARATUS

(76) Inventor: Jason Loomis, Decatur, GA (US)

( * ) Notice: Subject to any disclaimer, the term of this patent is extended or adjusted under 35 U.S.C. 154(b) by 0 days.

(21) Appl. No.: 12/836,425

(22) Filed: Jul. 14, 2010

Related U.S. Application Data

(60) Provisional application No. 61/225,258, filed on Jul. 14, 2009.

(51) Int. Cl.
*A47G 33/06* (2006.01)

(52) U.S. Cl. ..... 428/20; 362/123; 428/18

(58) Field of Classification Search ..... 428/17–20, 428/27; 362/123; 493/956
See application file for complete search history.

(56) References Cited

U.S. PATENT DOCUMENTS 4,855,880 A * 8/1989 Mancusi, Jr. ..... 362/123
5,409,745 A * 4/1995 McGuire ..... 428/18
5,422,797 A 6/1995 Shattan
5,652,032 A * 7/1997 Kaczor et al. ..... 428/18
5,776,559 A 7/1998 Woolford
6,457,839 B1 * 10/2002 Grandoit ..... 362/123
6,458,435 B1 10/2002 Lai
6,588,914 B1 7/2003 Tang
6,773,134 B2 8/2004 Harvey
6,840,663 B2 1/2005 Kao
7,052,156 B2 5/2006 Primeau
7,132,139 B2 * 11/2006 Yang ..... 428/17
7,144,610 B1 * 12/2006 Estes et al. ..... 428/19
7,585,552 B2 * 9/2009 Meseke ..... 428/19

* cited by examiner

*Primary Examiner* — Aaron Austin
(74) *Attorney, Agent, or Firm* — Larry D. Johnson

(57) ABSTRACT

An artificial tree apparatus having a plurality of tree trunk segments that couple together to provide electrical power to receptacles on each of the segments. An electrical line is connected to a first trunk segment electrical connector, such that when the first trunk segment is brought into juxtaposition with the second trunk segment, a detent on the first trunk segment can be brought into alignment with and slidably engage with a guide slot on the second trunk segment to permit connection of the first trunk segment electrical connector (socket) with the second trunk segment electrical connector (plug). The recessed location of the plug on the second segment protects the plug prongs, and connection with the corresponding socket on the first segment is only possible when the detent on the first segment has been aligned with the guide slot on the second segment.

10 Claims, 2 Drawing Sheets

ARTIFICIAL TREE APPARATUS

CROSS REFERENCE TO RELATED APPLICATIONS

The present application claims the benefit of the filing date of U.S. Provisional Patent Application Ser. No. 61/225,258, filed Jul. 14, 2009. The foregoing application is incorporated by reference in its entirety as if fully set forth herein.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to artificial trees, and more particularly to an improved artificial tree apparatus that is easily assembled and disassembled.

BACKGROUND INFORMATION AND DISCUSSION OF RELATED ART

U.S. Pat. No. 7,052,156 to Primeau discloses a combination artificial tree-lighting arrangement including a generally elongated tree trunk. The combination also includes a plurality of connecting components mountable on the tree trunk and a plurality of display components mountable on the connecting components. Each display component has tree limbs and lighting cables extending therefrom. The lighting cables are provided with decorative lights. An electrical circuitry connectable to an electrical power source is attachable to the connecting components. The electrical circuitry includes a connecting component-to-light coupling arrangement for electrically coupling the connecting components to the decorative lights. The connecting component-to-light coupling arrangement allows the display components to rotate relative to the connecting components about a rotation axis substantially parallel to the trunk longitudinal axis while maintaining the electrical coupling between the connecting components and the decorative lights.

U.S. Pat. No. 6,840,663 to Kao describes a panel branch for an artificial tree. The panel branch includes a plurality of twigs, a channel element, a number of inserts, and a hook-like member. Each twig is inserted through an aperture in the insert and the insert, in turn, is placed in and secured in the channel element. The hook-like member has a short side used to secure the branch to an artificial trunk and a long side secured in the channel element. Optical fibers are associated with the twigs of the panel branch. Each optical fiber is threaded through an aperture in an insert and gathered into a bundle. A socket with a light source is provided to receive the bundle of optical fibers such that the branch is lighted.

U.S. Pat. No. 6,773,134 to Harvey teaches an illuminated artificial tree having a display position and a folded position constructed of an odd number of upright wire mesh panels hingedly attached at their vertical inner edges, the panels including a first end panel, a second end panel and a plurality of intermediate panels between the first and second end panels. A string of decorative lights are attached in a plurality of spaced, reversed loops, the string extending from adjacent the lower edge of the first panel around the intermediate panels to the second panel, then upwardly along the outer edge of the second panel, and then back around the outer edges of the intermediate panels to the first panel, thereby permitting folding of the tree without removal of the light string.

U.S. Pat. No. 6,588,914 to Tang discloses an artificial tree structure with decorative lamps, comprising a plurality of hollow tubes or iron wires of various lengths, in the shape of tree branches, arranged from top to bottom around the main trunk supported by detachable legs. On each side sticks are installed a plurality of iron wires to form the shape of tree branches. The exterior of the hollow tubes or iron wires is wound by dense tree leaves. The lamps installed in the hollow tubes or on the iron wires are serially connected to become decorative lamp strings. The decorative lamp strings are then combined in parallel connection, running down the main trunk to be connected to a control box and a power transformer. The structure described above provides the artificial tree with decorative lamps, using the control box to produce music and lighting effects of different luminosity and flashing speeds.

U.S. Pat. No. 6,458,435 to Lai describes an artificial tree with a central trunk, a number of main branches suspended from an upper portion of the trunk in a downwardly and outwardly inclined orientation, and a preformed tree top section extending upwardly from the upper portion of the trunk. Each main branch includes a number of sub-branch clusters and a bundle of fiber optic conduits which terminate in the sub-branches. The bundles of fiber optic conduits are received in an opaque enclosure housing a high intensity light source, which enclosure is attached to the upper portion of the trunk. Electric lights are disclosed as an alternative means to illuminate the tree. The trunk includes upwardly open hook elements which receive pin elements within the interior of rigid support members of the main branches. Each sub-branch cluster is pivotally connected to an associated rigid support member to articulate between a collapsed position for storage and shipping, and an extended position for display.

U.S. Pat. No. 5,776,559 to Woolford teaches an electrified, artificial Christmas tree, which comprises both the artificial tree, composed of a stand and trunk with attachable branches, and various electrical components. The trunk portion of the tree is composed of a plurality of coupled sections which are joined together in a vertical orientation, and each of which has holes for branches to be inserted. The trunk pieces also have electrical sockets which are internally connected to the base of the trunk. The base of the trunk has attached to it another electrical socket and a master power cable. In use, the tree is assembled as any standard artificial tree, connecting trunk pieces together, and inserting into them branches of various sizes. Any conventional ornament or lighting fixture may be hung on these branches, and plugged into the trunk for power requirements. A stand at the base of the trunk provides stability, and internal circuit breakers provide assurance against fire. A line from the trunk is plugged into a powered electrical to provide power to the entire tree.

U.S. Pat. No. 5,422,797 to Shattan discloses an illuminated artificial tree and its method of manufacture in which a plurality of branches extend from a trunk of the tree, each branch being formed by spirally winding a strip assembly of a plurality of juxtaposed fiber optic elements and simulated pine needles on an elongated support wire. The fiber optic elements and simulated pine needles extend around the wire in adjacent relation to provide an interspersed array of pine needles and fiber optic elements all along the length of the branch. The fiber optic elements are illuminated at the base of the tree to provide points of light substantially all around each branch along its entire length. A member of branches are assembled along the trunk from the top down.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention provides an artificial tree apparatus having a plurality of tree trunk segments that couple together to provide electrical power to receptacles on each of the segments. The apparatus includes a first trunk segment having a cylindrical body with an outside wall and an internal cavity. The first trunk segment has an upper portion and lower portion, the upper portion having an outside diameter, a raised detent on the outside wall, and an end face bearing an electrical connector such as a socket. A second trunk segment also has a cylindrical body with an outside wall and an internal cavity, and also has an upper portion and lower portion, this lower portion having an inside diameter marginally greater than the first trunk segment upper portion outside diameter so that the first trunk segment upper portion can slide into and engage the second trunk segment lower portion. The second trunk segment lower portion has a notch or guide slot in the outside wall, and a recessed end face bearing an electrical connector such as a plug. An electrical line is connected to the first trunk segment electrical connector, such that when the first trunk segment upper portion is brought into juxtaposition with the second trunk segment lower portion, the detent on the first trunk segment upper portion can be brought into alignment with and slidably engage with the guide slot on the second trunk segment lower portion to permit connection of the first trunk segment electrical connector (socket) with the second trunk segment electrical connector (plug).

The recessed location of the plug on the second segment protects the plug prongs, and connection with the corresponding socket on the first segment is only possible when the detent on the first segment has been aligned with the guide slot on the second segment. That is, the plug and socket are positioned within their respective trunk segments so that not until the detent and guide slot on the segments are properly aligned are the plug prongs and the socket holes capable of connection.

The cylindrical shapes of the corresponding tree trunk segments facilitates connection of the segments, as juxtaposition and initial insertion of the first (male) segment into the second (female) segment can be achieved at any angular position, that is, the smaller diameter male portion can freely rotate within the larger diameter female portion when they are first inserted together. However, by locating the raised detent a short distance (offset) from the socket on the end face, complete connection of the plug prongs with the socket is prevented until the two segments are rotated relative to one another until the guide slot and detent are properly aligned, ensuring that the plug prongs will then slide straight into the socket holes.

The artificial tree apparatus of the present invention thus provides an improved coupling arrangement for the trunk portions of an artificial tree in which each section, besides connecting easily, carries current and any other important electrical information or commands via the tree column. Each section is thus electrically contained, meaning that the lighting source (string), whether it be incandescent or LED plug in strings (AC) or strictly DC operated LED strings, connects/plugs into its corresponding section of the column (trunk) of the tree. This design will also work for unlit trees (where the consumer strings the tree) but is mostly considered for pre-lit trees.

Each section of the tree couples with its connecting partner, thus delivering the current through the column of the tree from a connector/controller/plug that plugs into an AC socket. This makes assembly and disassembly much easier for the user. No need to plug individual strings together or plug strings from one section of tree to another or run long electrical leaders to other areas of the tree. To assemble, just couple each section together and turn it on. Each section of column couples together mechanically and electrically. To disassemble, just fold up the branches up and de-couple each section.

One embodiment of the inventive apparatus includes a DC motor in the base that allows the tree to rotate. A wireless remote control allows the user to turn the lights on and off and turn the rotation motor on and off via the power/controller box (power transformer/light controller/tree rotation controller box). A tapered top section perfectly connects with a tree topper socket.

A DC version may be different in that it has DC socket connections in the column of the tree instead of AC sockets. On this version the voltage is reduced at the controller box plugged in at the wall so all voltage beyond that point is low voltage.

The controller box may contain a voice activated light controller, and in the DC version the user may be able to turn the tree lights on and off via a special touch sensor ornament (e.g., a metal snowflake) that is permanently attached to the tree.

In one embodiment, small DC connector interfaces are placed on the middle column of the tree (trunk). This enables pre lit trees that are lit with low voltage LED strings that connect directly into the middle column of the tree. If one string goes out the user can easily identify the rogue string, unplug it and replace it with a working string. Gone are the days of strings all connected together in a confusing mess.

The coupling system between each section of tree in the DC version may be different than the AC version. These extra connectors allow for additional information transfer from the controller/voltage box to the tree; e.g., a touch activated on/off switch built into the tree, lighting effects, etc.

The top section of the middle column may have one or more AC type plug; this allows the user to plug some already existing low voltage device, such as an illuminated tree topper into the tree without having to run an extension cord down to the floor and into an outlet.

It is therefore an object of the present invention to provide a new and improved artificial tree.

It is another object of the present invention to provide a new and improved artificial illuminated tree that is easily assembled and disassembled.

A further object or feature of the present invention is a new and improved artificial tree that carries current and any other important electrical information or commands via the tree column.

An even further object of the present invention is to provide a novel artificial tree where the lighting source plugs into its corresponding section of the column (trunk) of the tree.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
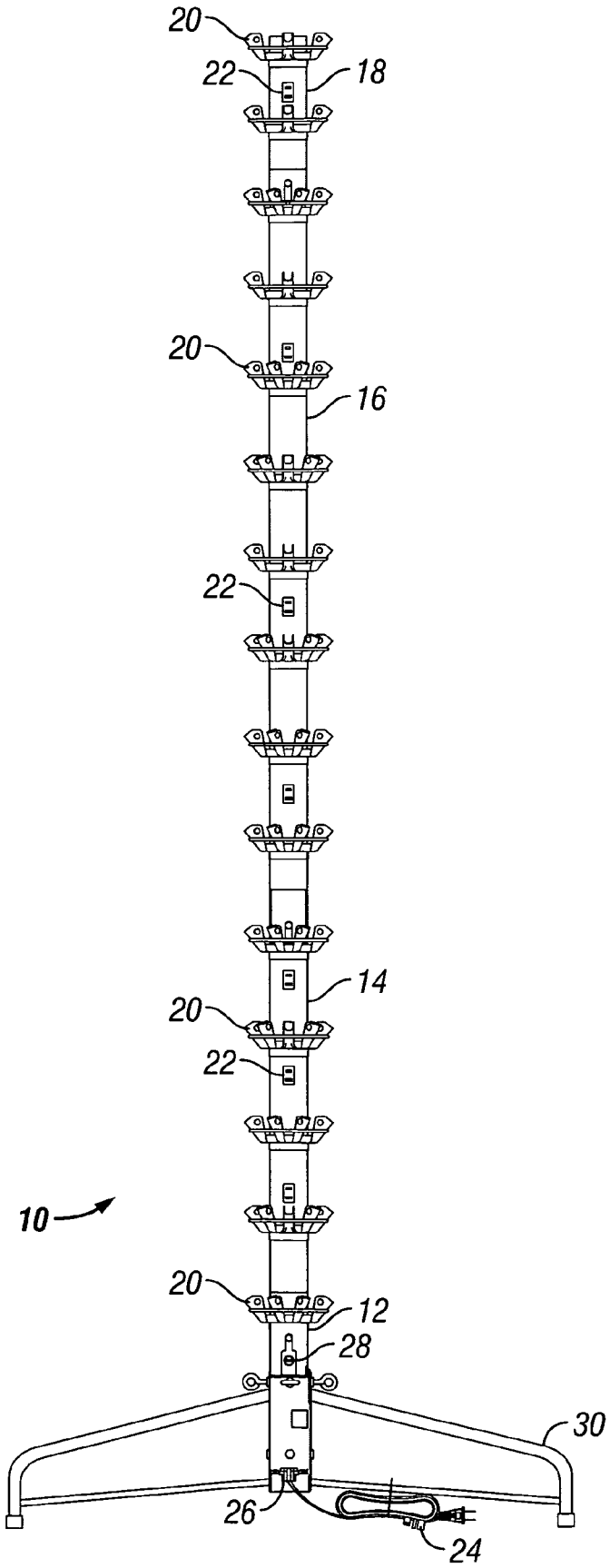
FIG. 1 is a side elevation view of an artificial tree apparatus of this invention as assembled but without branches or light strings installed.
Figure 2:
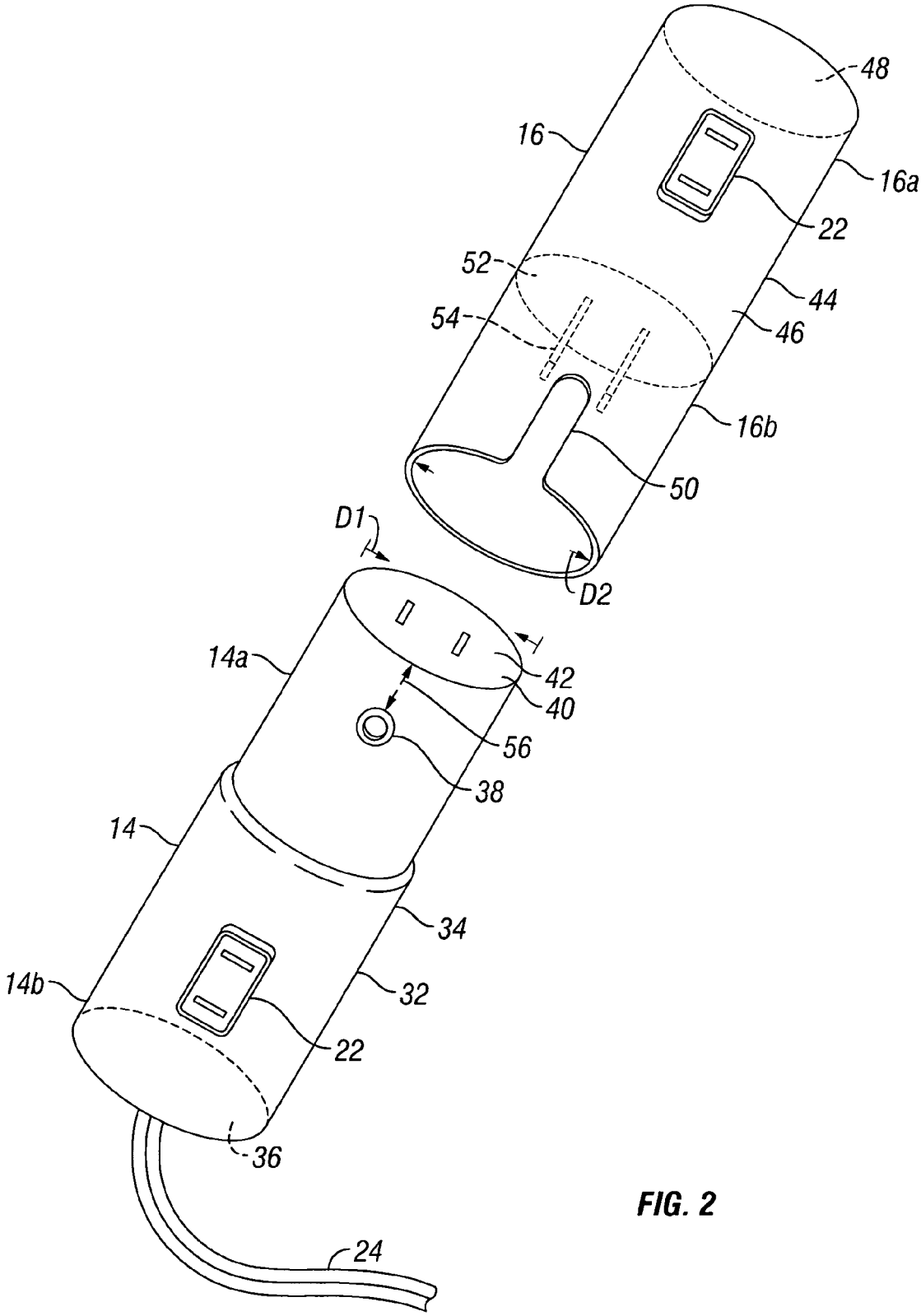
FIG. 2 is a perspective view illustrating the coupling of two trunk segments.

Referring to FIGS. 1 and 2, wherein like reference numerals refer to like components in the various views, there is illustrated therein a new and improved artificial tree apparatus, generally denominated 10 herein. FIG. 1 is a side elevation view of an artificial tree apparatus 10 of this invention as assembled but without branches or light strings installed. Tree 10 includes a plurality of tree trunk segments 12, 14, 16, 18, each preferably carrying one or more branch supports 20 for connection to artificial branches (not illustrated), and one or more electrical receptacles 22 (e.g., 15 A 125V) for connection to series or series parallel connected lighting strings (not illustrated). Power cord 24 is connected to base segment 12 with strain relief 26, and supplies power to all of the receptacles 22 on the assembled segments. Base segment 12 may also include a fuse (e.g. 5 A 125V) and fuse holder 28 interposed in the power cord, and a tree stand 30.

FIG. 2 is a perspective view illustrating the coupling of two trunk segments 14, 16. First trunk segment 14 has a cylindrical body 32 with an outside wall 34 and an internal cavity 36. The first trunk segment 14 has an upper portion 14*a* and lower portion 14*b*, the upper portion 14*a* having an outside diameter D1, a raised feature or detent 38 on the outside wall 34, and an end face 40 bearing an electrical connector such as a socket 42 (e.g., 15 A 125V). Second trunk segment 16 also has a cylindrical body 44 with an outside wall 46 and an internal cavity 48, and also has an upper portion 16*a* and lower portion 16*b*, this lower portion having an inside diameter D2 marginally greater than the first trunk segment upper portion 14*a* outside diameter D1 so that the first trunk segment upper portion 14*a* can slide into and engage the second trunk segment lower portion 16*b*. The second trunk segment lower portion 16*b* has a notch or guide slot 50 in the outside wall 46, and a recessed end face 52 bearing an electrical connector such as a plug 54. The electrical line 24 is connected to the first trunk segment electrical connector 42, such that when the first trunk segment upper portion 14*a* is brought into juxtaposition with the second trunk segment lower portion 16*b*, the detent 38 on the first trunk segment upper portion 14*a* can be brought into alignment with and slidably engage with the guide slot 50 on the second trunk segment lower portion 16*b* to permit connection of the first trunk segment electrical connector (socket) 42 with the second trunk segment electrical connector (plug) 54.

The recessed location of the plug on the second segment protects the plug prongs, and connection with the corresponding socket on the first segment is only possible when the detent 38 on the first segment has been aligned with the guide slot 50 on the second segment. By locating the raised detent 38 a short distance (offset 56) from the socket on the end face 40, complete connection of the plug 54 with the socket 42 is prevented until the two segments are rotated relative to one another until the guide slot and detent are properly aligned, ensuring that the plug prongs will then slide straight into the socket holes.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. An artificial tree apparatus comprising:

a first trunk segment having a cylindrical body with an outside wall and an internal cavity, said first trunk segment having an upper portion and lower portion; said upper portion having an outside diameter, a raised detent on said outside wall, and an end face bearing an electrical connector;

a second trunk segment having a cylindrical body with an outside wall and an internal cavity, said second trunk segment having an upper portion and lower portion; said lower portion having an inside diameter greater than said first trunk segment upper portion outside diameter, a guide slot in said outside wall, and a recessed end face bearing an electrical connector; and an electrical line connected to said first trunk segment electrical connector, wherein when said first trunk segment upper portion is brought into juxtaposition with said second trunk segment lower portion, said detent on said first trunk segment upper portion can be brought into alignment with and slidably engage said guide slot on said second trunk segment lower portion to permit connection of said first trunk segment upper portion end face electrical connector and said second trunk segment lower portion recessed end face electrical connector.

2. The artificial tree apparatus of claim 1 wherein at least one of said first trunk segment and said second trunk segment outside walls bears an electrical receptacle connected to said electrical line.

3. The artificial tree apparatus of claim 1 wherein said first trunk segment bears an electrical fuse in said electrical line.

4. The artificial tree apparatus of claim 3 wherein said electrical fuse is located in said central cavity and is accessed through said outside wall.

5. The artificial tree apparatus of claim 1 wherein said detent on said first trunk segment upper portion is offset from said first trunk segment upper portion end face.

6. The artificial tree apparatus of claim 1 wherein said first trunk segment electrical connector comprises an electric socket.

7. The artificial tree apparatus of claim 1 wherein said second trunk segment electrical connector comprises an electric plug.

8. The artificial tree apparatus of claim 1 wherein said first trunk segment upper portion comprises a reduced diameter section of said first trunk segment cylindrical body.

9. The artificial tree apparatus of claim 1 wherein said first trunk segment is attached to a tree stand.

10. The artificial tree apparatus of claim 1 wherein said electrical line is secured to said first trunk segment internal cavity with a strain relief.

* * * * *